US009545729B2

(12) United States Patent
Buck, Jr. et al.

(10) Patent No.: US 9,545,729 B2
(45) Date of Patent: Jan. 17, 2017

(54) HAIR TRIMMER BLADE SET WITH ADJUSTABLE BLADES

(71) Applicant: Wahl Clipper Corporation, Sterling, IL (US)

(72) Inventors: Robert N. Buck, Jr., Rock Falls, IL (US); Scott Melton, Erie, IL (US)

(73) Assignee: WAHL CLIPPER CORPORATION, Sterling, IL (US)

( * ) Notice: Subject to any disclaimer, the term of this patent is extended or adjusted under 35 U.S.C. 154(b) by 84 days.

(21) Appl. No.: 14/669,358

(22) Filed: Mar. 26, 2015

(65) Prior Publication Data

US 2016/0279813 A1 Sep. 29, 2016

(51) Int. Cl.
*B26B 19/06* (2006.01)
*B26B 19/38* (2006.01)

(52) U.S. Cl.
CPC ..... *B26B 19/063* (2013.01); *B26B 19/3846* (2013.01)

(58) Field of Classification Search
CPC ..... B26B 19/063; B26B 19/3846
See application file for complete search history.

(56) References Cited

U.S. PATENT DOCUMENTS 1,774,046 A 8/1930 Wahl
2,292,364 A 8/1942 Cromonic
3,093,901 A 6/1963 Wahl
3,458,932 A * 8/1969 Fox ..... B26B 19/28 30/220
4,557,050 A 12/1985 Haraguchi et al.
5,068,966 A 12/1991 Wahl et al.
5,325,589 A 7/1994 Kubo
6,260,276 B1 * 7/2001 Lebherz ..... B26B 19/205 30/200
6,742,262 B2 * 6/2004 Rizzuto, Jr. ..... B26B 19/205 30/201
2003/0005585 A1 1/2003 Rizzuto, Jr. et al.
2007/0044320 A1 * 3/2007 Fukutani ..... B26B 19/205 30/201
2008/0282550 A1 * 11/2008 Piwaron ..... B26B 19/06 30/210
2009/0056143 A1 * 3/2009 Fukutani ..... B26B 19/06 30/43.92

(Continued)

FOREIGN PATENT DOCUMENTS

EP 0856386 A1 8/1998

OTHER PUBLICATIONS

Partial European Search Report from European Patent Application No. 16161723.8, mailed Aug. 17, 2016.

*Primary Examiner* — Sean Michalski
*Assistant Examiner* — Liang Dong
(74) *Attorney, Agent, or Firm* — Greer, Burns & Crain, Ltd.

(57) ABSTRACT

An adjustable hair trimmer blade set is provided, including a blade chassis, a blade platform linearly displaceable relative to the blade chassis, a stationary blade secured to the blade platform, and a moving blade constructed and arranged for slidable linear reciprocation relative to the stationary blade in a direction of cutting action. An offset rod has at least one offset cam lobe and is rotatably engaged in the chassis along an axis generally parallel to the direction of cutting action. A retaining spring has at least one loop engaged by the offset rod for holding the spring in operational relationship to the chassis.

13 Claims, 6 Drawing Sheets

(56) References Cited

U.S. PATENT DOCUMENTS

2009/0144988 A1* 6/2009 Lau ..... B26B 19/205
30/208
2012/0272533 A1 11/2012 Sobagaki et al.

* cited by examiner

HAIR TRIMMER BLADE SET WITH ADJUSTABLE BLADES

BACKGROUND

The present invention relates generally to electric hair cutting devices, such as hair clippers and hair trimmers, and more specifically to blade sets for such devices. In particular, the present invention is related to blade sets designed for hair trimmers.

Conventional electric hair cutting devices include an electric motor having an output shaft with an offset cam engaging a blade set. The blade set includes a moving blade constructed and arranged to linearly reciprocate relative to a stationary blade. Both blades have complementary toothed edges, and the relative movement of the moving blade to the stationary blade creates a scissors-like cutting action. The blade set is usually removable from the device for cleaning, sharpening and other maintenance. A suitable example of conventional hair cutting device blade set design is disclosed in commonly-assigned U.S. Pat. No. 5,068,966, which is incorporated by reference. Hair clippers are usually considered more powerful and used for relatively larger cutting jobs, such as providing a major portion of a haircut, while hair trimmers are used for more detailed operations, such as trimming beards, mustaches and the like. As such, trimmer blade sets are often smaller in all dimensions than clipper blade sets.

One problem faced by trimmer blade set designers is maintaining the alignment of the moving blade relative to the stationary blade during the entire reciprocal path of cutting operation. Any misalignment of the moving blade can cause poor cutting or nicking of the person receiving the trim.

Another problem faced by trimmer blade set designers is providing the ability to move the position of the points or ends of the cutting teeth on the moving blade back and forth relative to the complementary teeth of the stationary blade in a direction transverse to the direction of blade cutting action, for the purposes of obtaining a cut closer to or farther from, the skin as desired. This feature is common on clipper blade sets, but it has been difficult to achieve in the smaller confines of a trimmer blade set.

Thus, there is a need for an improved hair trimmer blade set that addresses the design issues identified above.

SUMMARY

The above-identified needs are met by the present hair trimmer blade set, which features a main blade chassis including integral guide arms configured for capturing a cam follower guiding the moving blade relative to the stationary blade. Formations on the arms slidably accommodate the cam follower, but inhibit transverse movement of the cam follower. In this manner, alignment is maintained between the moving blade and the stationary blade throughout the reciprocal travel cycle of the moving blade.

Another feature of the present blade set is that an offset rod transversely engages the blade chassis and includes offset cams used for adjusting the position of the stationary blade relative to the moving blade as desired, as the rod is rotated about its axis by the user manipulating a lever. Such rotation causes transverse movement of a blade platform and the stationary blade relative to cam follower and the moving blade.

Still another feature is that the same offset rod provides anchor points for a retaining or torsion spring used to exert a biasing force on the moving blade. The rod holds the spring in the chassis by engaging loops of the spring which are inserted under pressure through corresponding slots in the blade chassis. By the same token, the engagement with the spring holds the rod in place relative to the blade chassis. As is known in the art, free ends of the retaining spring engage the cam follower and bias it against the moving blade, which in turn is biased against the stationary blade.

More specifically, an adjustable hair trimmer blade set is provided, including a blade chassis, a blade platform linearly displaceable relative to the blade chassis, a stationary blade secured to the blade platform, and a moving blade constructed and arranged for slidable linear reciprocation relative to the stationary blade in a direction of cutting action. An offset rod has at least one offset cam lobe and is rotatably engaged in the chassis along an axis generally parallel to the direction of cutting action. A retaining spring has at least one loop engaged by the offset rod for holding the spring in operational relationship to the chassis.

In another embodiment, an adjustable hair trimmer blade set is provided, including a blade chassis, a blade platform linearly displaceable relative to the blade chassis, a stationary blade secured to the blade platform, and a moving blade constructed and arranged for slidable linear reciprocation relative to the stationary blade in a direction of cutting action. A cam follower is associated with the moving blade, and has a guiding track extending parallel to the direction of cutting action. The blade chassis has at least one arm having at least one guide formation slidingly engaging the track for maintaining alignment of the moving blade relative to the stationary blade during trimmer operation.

DETAILED DESCRIPTION

Figure 1:
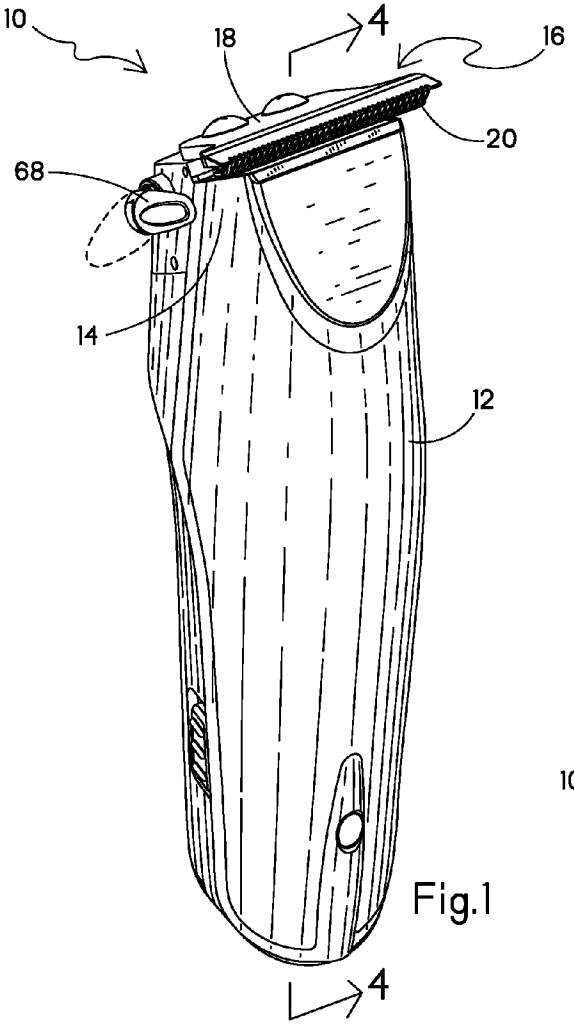
FIG. 1 is a perspective view of a hair clipper equipped with the present blade set.

Referring to FIG. 1, a hair trimmer suitable for use with the present blade set is generally designated 10 and includes a housing 12 with an operational end 14 to which is attached the present blade set, generally designated 16. As is known in the art, the blade set 16 includes a stationary blade 18 and a moving blade 20 slidable and linearly reciprocating relative to the stationary blade for achieving the desired cutting action. The motion of the moving blade 20 relative to the stationary blade is referred to as a direction of cutting action. The blade set 16 is removably attached to the operational end 14 for cleaning, sharpening of the blades 18, 20 or other maintenance.

Figure 2:
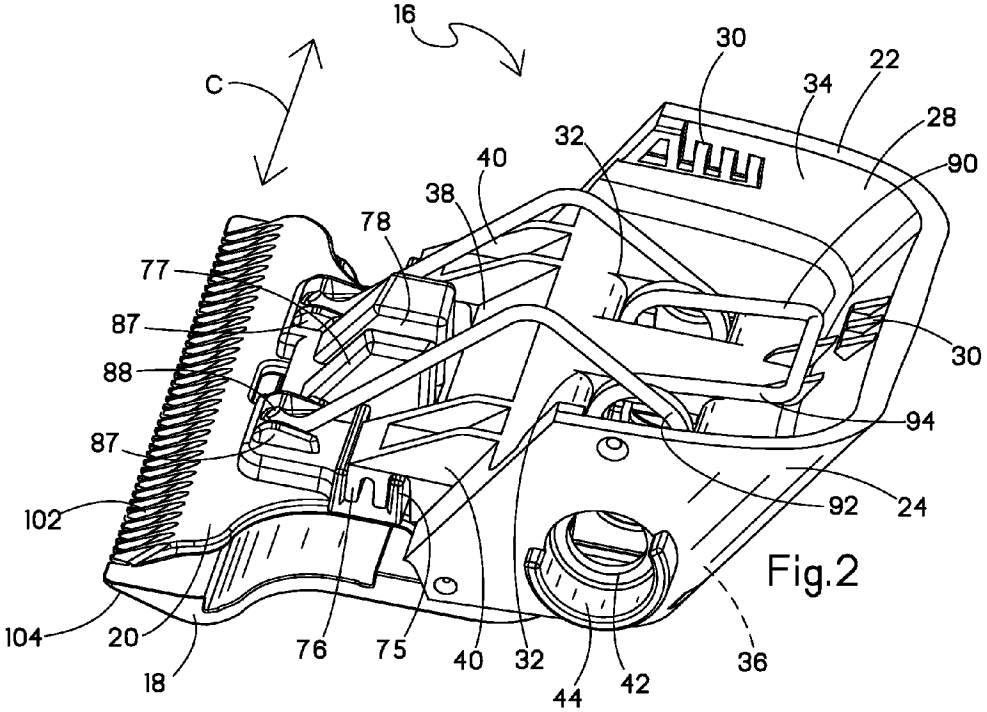
FIG. 2 is a fragmentary top perspective view of the present blade set.
Figure 3:
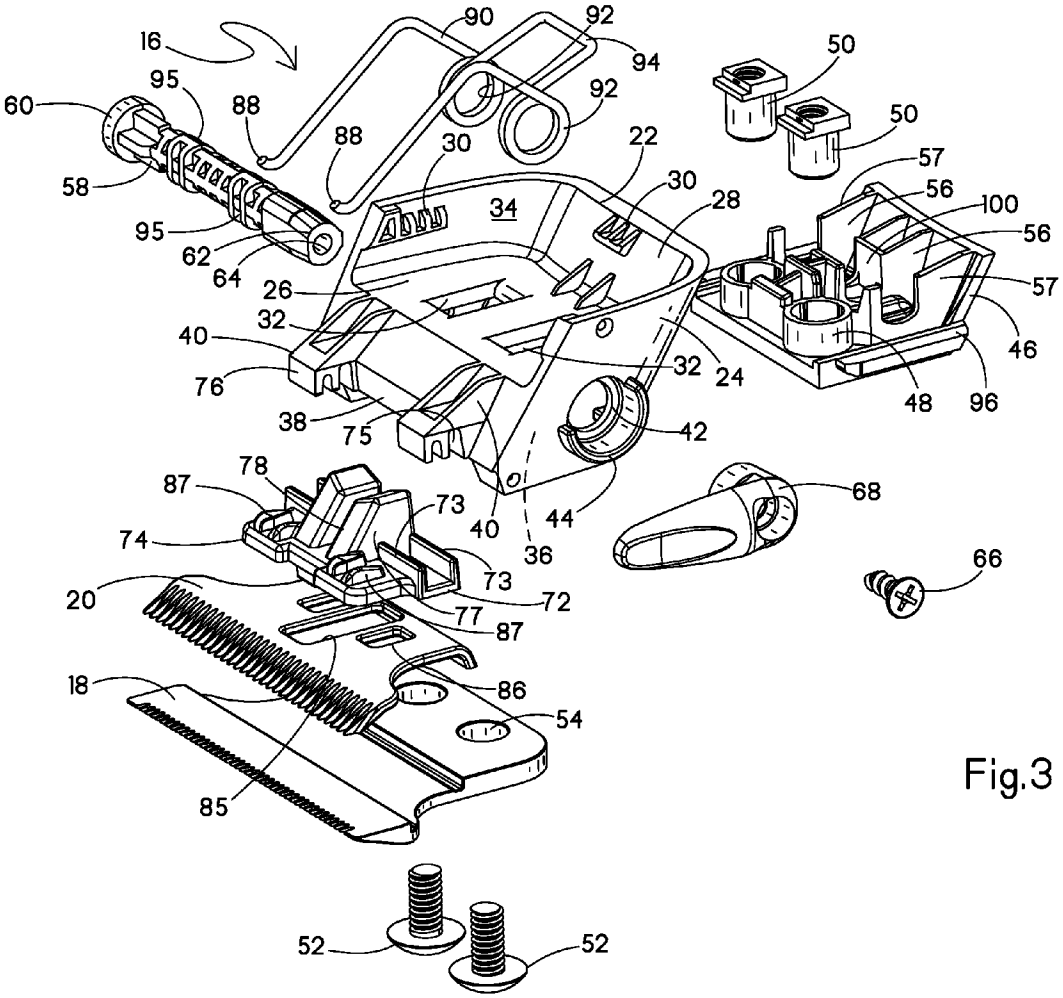
FIG. 3 is a top exploded perspective view of the complete blade set of FIG. 2.

Referring now to FIGS. 2 and 3, the blade set 16 includes a blade chassis 22 having an outer shell 24 to which is attached, as by integral molding, a floor 26. An inner wall 28 of the shell 24 is provided with at least one and preferably a plurality of gripping formations 30 used to grip the operational end 14 of the housing for holding the blade set 16 in place. At least one and preferably a pair of spring slots 32 are formed in the floor 26, which divides the shell 24 into an upper chamber 34 and a lower chamber 36. A front edge 38 of the floor 26 has at least one and preferably a pair of guide arms 40, described in greater detail below. Also included on the shell 24 is a pair of opposed rod apertures 42, at least one of which is provided with a laterally extending lever cradle 44.

Also included on the blade set 16 is a blade platform 46 that is slidably movable relative to the blade chassis 22 in a direction transverse to the movement of the moving blade 20 relative to the stationary blade 18, the latter movement also referred to as the cutting direction "C" (FIG. 2). Included on the blade platform 46 is at least one insert socket 48, each constructed and arranged for accommodating an associated threaded insert 50. The inserts 50 each receive a blade screw 52 that passes through a corresponding fastener bore 54 in the stationary blade 18. Thus, the stationary blade 18 is secured to the blade platform 46 for common movement.

The blade platform 46 further includes a rod recess 56 located farther from the stationary and moving blades 18, 20 than are the sockets 48. The rod recess 56 is defined by a plurality of internal ribs 57 and is dimensioned for rotatingly accommodating an offset rod 58 (best seen in FIG. 5) having a length that at least spans the chassis 22 from one rod aperture 42 to the other. At one rod end 60 is found a relatively large diameter knob or cap that is larger in diameter than the rod aperture 42, thus preventing the rod from totally passing through the aperture. At an opposite lever end 62 has a bore 64 with a preferably non-circular exterior surface for receiving a fastener 66 securing a lever 68. Rotation of the lever 68 causes like rotation of the offset rod 58 in the rod recess 56.

Figure 7:
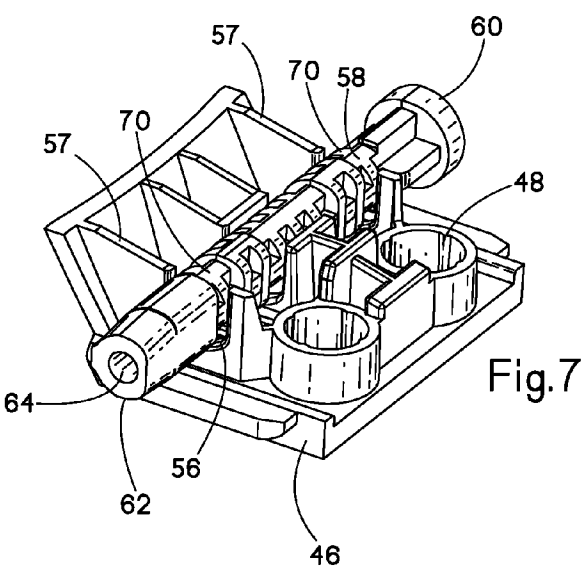
FIG. 7 is a top perspective view of the offset rod engaged on the blade platform.
Figure 5:
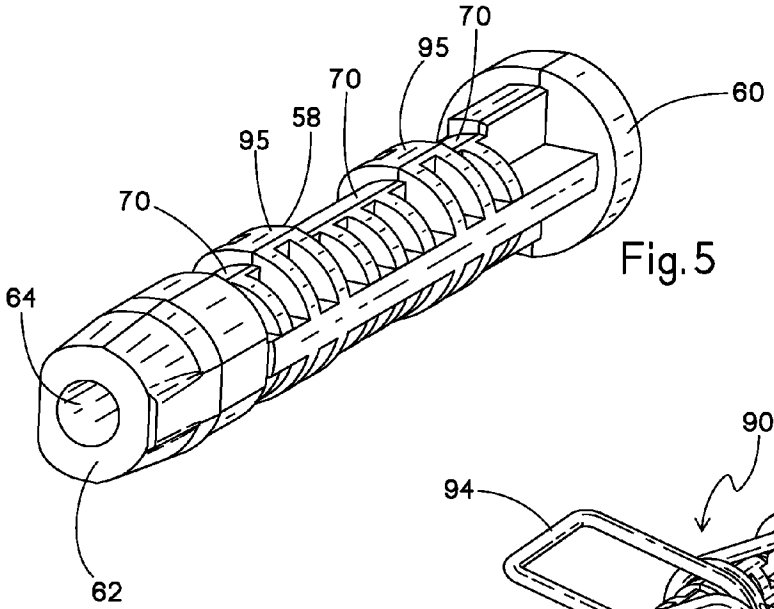
FIG. 5 is a top perspective view of the present offset rod.

Referring now to FIGS. 3, 5 and 7, it will be seen that the offset rod 58 has at least one and preferably three offset cam-type lobes 70, each extending in the same direction relative to a longitudinal axis of the offset rod. As will be described below, the lobes 70 are used to move the stationary blade 18 relative to the moving blade 20 as the lever 68 is rotated in a first direction, and in a reverse direction relative to the moving blade when the lever is rotated in a second direction.

Figure 4:
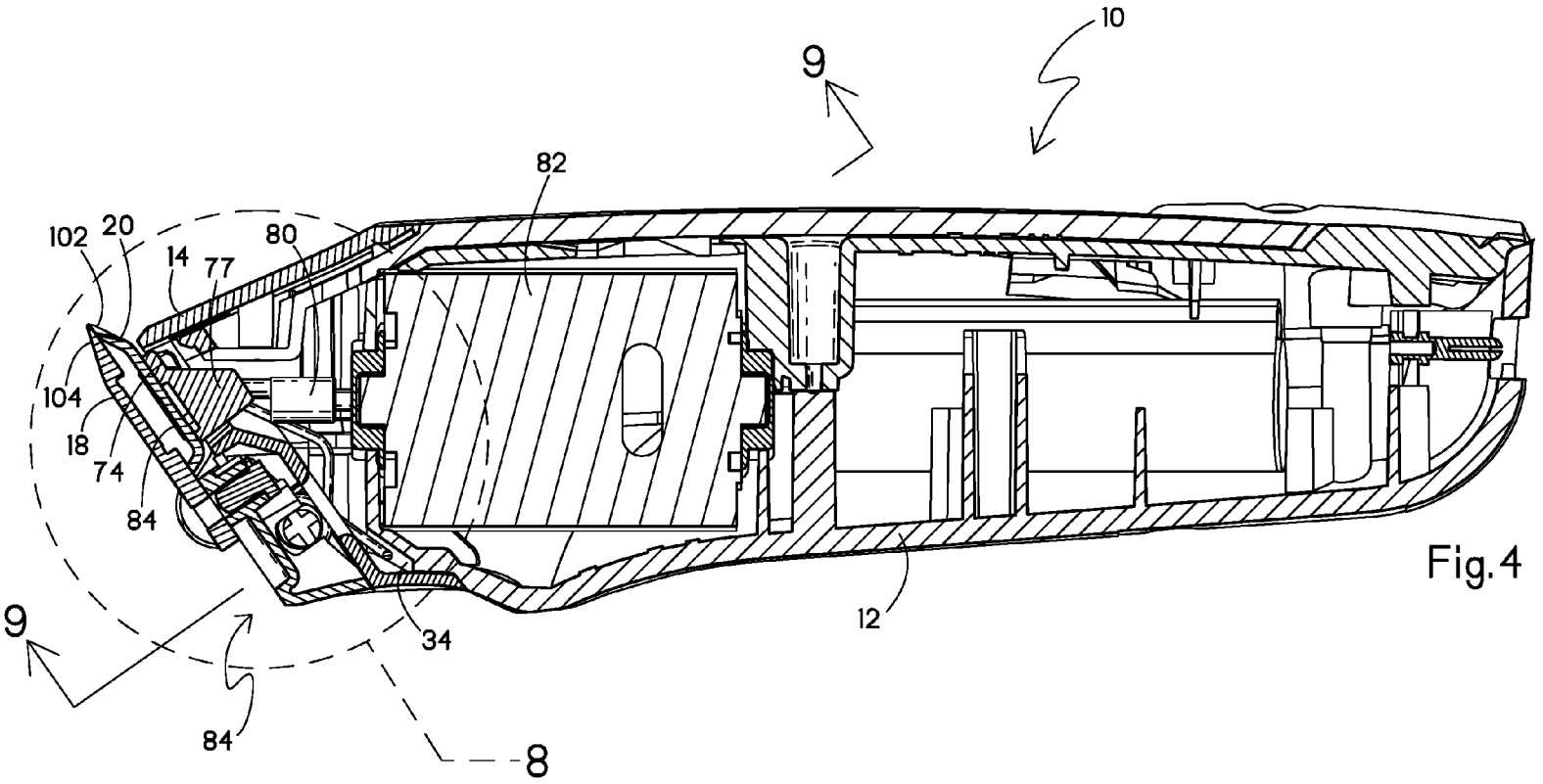
FIG. 4 is a vertical section of the present hair trimmer taken along the line 4-4 of FIG. 1 and in the direction generally indicated.

Referring now to FIGS. 2, 3 and 4, the guide arms 40 slidingly engage and guide a "U"-shaped track 72 having a pair of spaced, vertically projecting rails 73 of a cam follower 74. A groove 75 in the guide arm 40 provides clearance accommodating sliding movement of the track 72. A lug portion 76 of the guide arm substantially fills the track 72, has sufficient clearance for slidingly accommodating the movement of the track, and thus provides proper alignment of the cam follower 74 and the moving blade 20 relative to the stationary blade 18 during trimmer operation. As is well known in the powered clipper art, the cam follower includes a pair of generally vertically projecting drive tabs 77 constructed and arranged to define a space 78 dimensioned for receiving a drive cam 80 (FIG. 4). Rotation of the drive cam 80 induced by the motor 82 causes the cam follower 74 to linearly reciprocate. Since the cam follower 74 is secured to the moving blade 20 for common movement, the moving blade 20 reciprocates relative to the stationary blade 18, causing the desired cutting action. As is well known in the art, the cam follower 74 includes a depending tongue 84 (FIGS. 4, 8, 9) that matingly engages a slot 85 in the moving blade 20. Another pair of tongues (not shown) engage each of two slots 86 on either side of the slot 85 for further stabilization of the moving blade 20 as is known in the art.

Also included on the cam follower 74 is at least one and preferably a pair of spring retainers 87, each configured for releasably securing free ends 88 of a torsion spring 90, also called a retaining spring. The torsion spring 90 exerts a downward pressure on the cam follower 74 which biases the moving blade 20 against the stationary blade 18.

Figure 6:
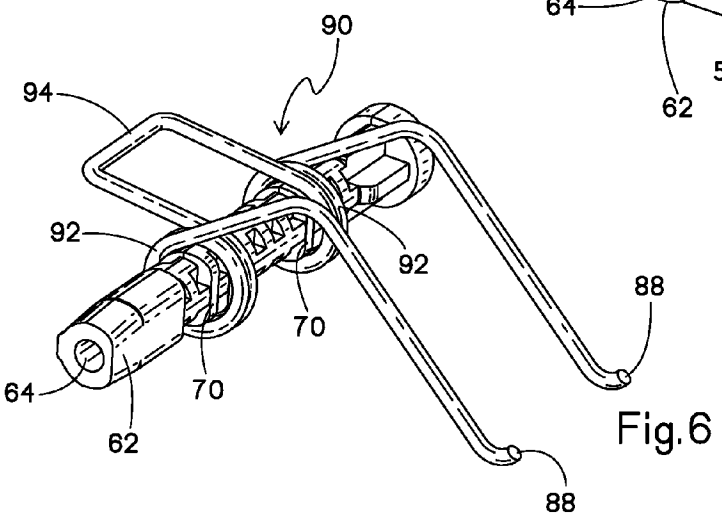
FIG. 6 is a perspective view showing the rod engaged with the retaining spring.

Referring now to FIGS. 2, 3 and 6, another function of the torsion spring 90 in the present blade set 16 is to hold the offset rod 58 in place in the blade chassis 22. Accordingly, the torsion spring 90 also includes a pair of spaced loops 92 secured together by a generally "U"-shaped bridge portion 94. The loops 92 are dimensioned to slide into the spring slots 32 in the chassis floor 26. When the blade set 16 is assembled, the torsion spring 90 is disposed so that the loops are located in the slots 32 and the free ends 88 are engaged on the cam follower 74. At this time, however the loops 92 are not in alignment with the rod apertures 42 due to the "at rest" construction of the torsion spring 90.

An installer presses downward on the spring 90, overcoming the inherent biasing force of the spring and placing the loops 92 in alignment with the rod apertures 42 in the chassis 22. Once aligned, the offset rod 58 is inserted into the rod apertures 42 so that the rod engages the loops 92, specifically at formations 95. Release of the spring 90 by the user causes the biasing force of the spring to hold the rod 58 in place in the chassis 22. After the offset rod 58 is fully inserted, the lever 68 is secured, using the fastener 66.

Thus, this relationship between the torsion spring 90 and the offset rod 58 is that the engagement of the rod in the loops also holds the spring in operational relationship to the chassis 22.

Figure 9:
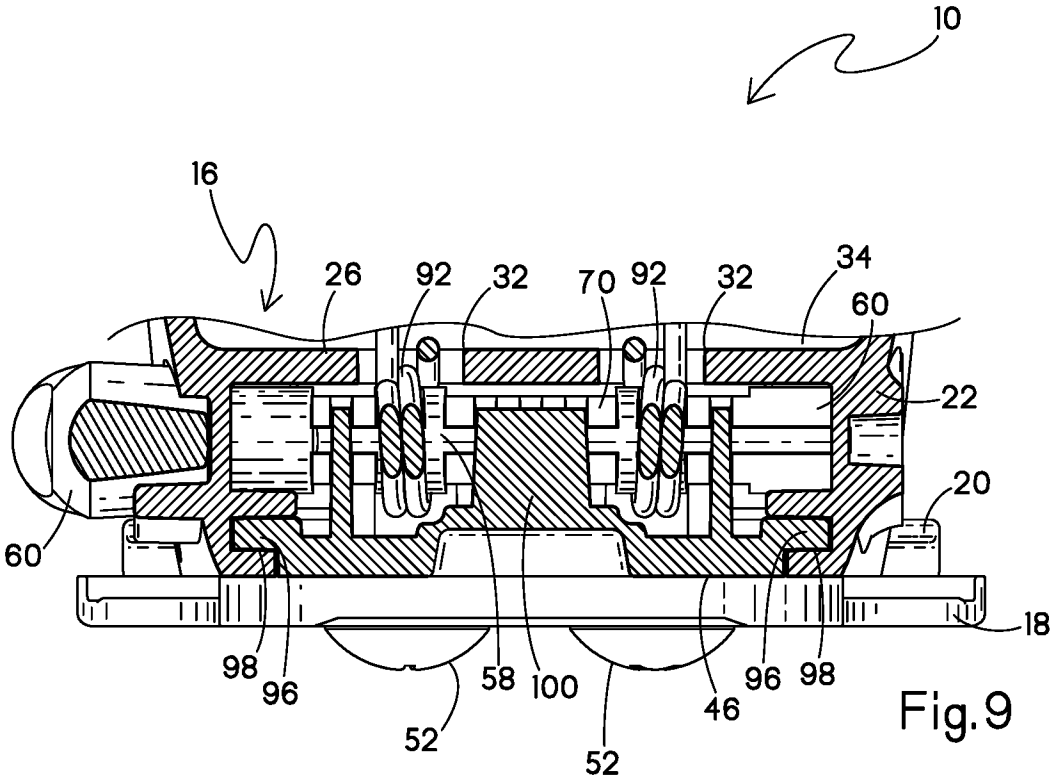
FIG. 9 is a cross-section taken along the line 9-9 of FIG. 4 and in the direction generally indicated.

Referring now to FIGS. 3, and 9, the blade platform 46 is slidingly secured to the blade chassis 22 by virtue of laterally projecting ribs 96 on the platform that slidingly engage an elongate groove 98 in the chassis. As the user actuates the lever 68 and rotates the offset rod 58, which, as described above is captured in the chassis 22, the cam lobes 70 will engage a platform surface 100 on the platform 46, as well as other selected surfaces of the ribs 57, thus causing movement of the stationary blade 18 relative to the moving blade 20 in a direction transverse to the cutting direction "C". Since the offset rod 58 is captured relative to the blade chassis 22, but is also cradled in the rod recess 56 of the blade platform 46, engagement of the cam lobes 70 against the surface 100 will force the platform away from the chassis, farther from the blade 20 and transverse to the direction of cutting action.

Figure 8A:
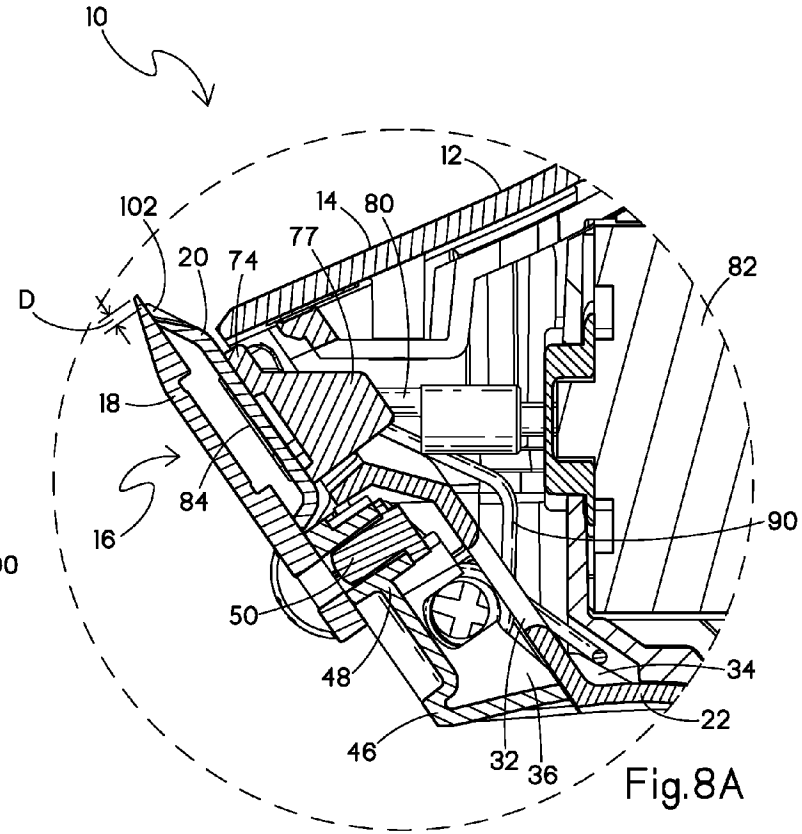
FIG. 8A is an enlarged fragmentary section of the present blade set in a second position, with the stationary blade teeth tips transversely extended relative to the moving blade teeth tips.
Figure 8:
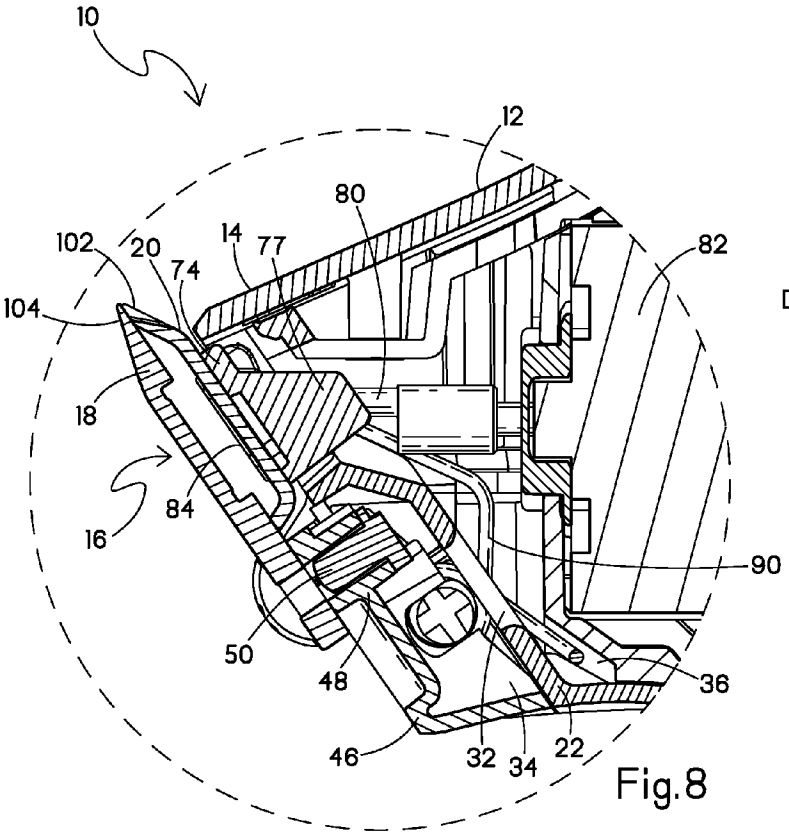
FIG. 8 is an enlarged fragmentary section of the present blade set in a first position, with the moving blade teeth tips even with the stationary blade teeth tips.

As seen in FIG. 8, tips 102 of teeth on the moving blade 20 are relatively flush with corresponding tips 104 of teeth on the stationary blade 18. This orientation provides a sharp cutting edge for the user of the trimmer 10, of the type used in outlining and other hair cutting techniques calling for sharp cut hair edges. This position is achieved with the lever 68 pointing towards the teeth 102, 104 (shown in solid lines in FIG. 1). This position reflects a deflection of the blade platform 46 to the fullest extent towards the rear of the blade chassis 22, farthest from the tips 102.

In FIG. 8A, the lever 68, and the offset rod 58, are shown having been rotated to the fullest extent so that the lever points away from the tips 102, 104 (seen in dashed lines in FIG. 1). In this position, the tips 104 are extended a distance "D" from the tips 102. The movement between FIGS. 8 and 8A to create the distance "D" is approximately 0.020 inch, however the amount of displacement may vary to suit the application.

Thus, it will be seen that the present blade set 16 provides improved features compared to conventional trimmer blade sets, including improved guiding structures for the cam follower, and accordingly, the moving blade 20 relative to the stationary blade 18. In addition, the structural cooperation between the offset rod 58 and the torsion spring 90 enhances the retention of both components in the blade chassis 22.

While a particular embodiment of the present hair trimmer blade set with adjustable blades has been shown and described, it will be appreciated by those skilled in the art that changes and modifications may be made thereto without departing from the invention in its broader aspects and as set forth in the following claims.

What is claimed:

1. An adjustable hair trimmer blade set, comprising:

a blade chassis;

a blade platform linearly displaceable relative to said blade chassis;

a stationary blade secured to said blade platform;

a moving blade constructed and arranged for slidable linear reciprocation relative to said stationary blade in a direction of cutting action;

an offset rod having at least one offset cam lobe and being rotatably engaged in said chassis along an axis generally parallel to the direction of cutting action; and a retaining spring having at least one loop engaged by said offset rod for holding said spring in operational relationship to said chassis.

2. The blade set of claim 1 wherein said at least one cam on said offset rod is constructed and arranged so that upon rotation of said rod about a longitudinal axis, said blade platform and said stationary blade move relative to said moving blade in a direction transverse to said direction of cutting action.

3. The blade set of claim 1 wherein said offset rod engages said loops of said spring in locations disposed between said at least one lobe.

4. The blade set of claim 1, wherein said retaining spring has at least one free end constructed and arranged for engaging a cam follower associated with said moving blade.

5. The blade set of claim 4, wherein said cam follower has a guiding track extending parallel to the direction of cutting action, and said chassis has at least one arm having guide formations slidingly engaging said track.

6. The blade set of claim 5, wherein said cam follower track has a pair of vertically projecting rails, and each said arm has a complementary lug dimensioned for slidingly engaging said track between said rails.

7. The blade set of claim 5, wherein each arm extends from a front edge of said chassis.

8. The blade set of claim 1, wherein said blade platform includes a recess for receiving said offset rod, and is slidably secured to said chassis by ribs on said platform each engaging a groove on said chassis.

9. The blade set of claim 1, further including a lever secured to an end of said offset rod for enabling user rotation of said rod relative to said chassis.

10. The blade set of claim 1, wherein said chassis includes a pair of slots, each said slot constructed and arranged for receiving an associated loop of said spring, said spring being depressed relative to said chassis so that said loops are engaged by said offset rod.

11. The blade set of claim 1 wherein rotation of said offset rod between a first position and a second position causes transverse relative movement of said stationary blade to said moving blade in the range of 0.020 inch.

12. The blade set of claim 1 wherein said offset rod includes cam lobes for causing relative transverse movement of said stationary blade relative to said moving blade, and retains said retaining spring relative to said chassis.

13. The blade set of claim 12, wherein said offset rod includes at least a pair of axially spaced cam lobes separated by spring retaining locations.

* * * * *